United States Patent [19]

Herbst et al.

[11] 4,164,105

[45] * Aug. 14, 1979

[54] FRAME STRUCTURE

[75] Inventors: Walter B. Herbst, Evanston; Ralph M. Lazar, Skokie, both of Ill.

[73] Assignee: Tenneco Chemicals, Inc., Saddle Brook, N.J.

[ * ] Notice: The portion of the term of this patent subsequent to Feb. 14, 1995, has been disclaimed.

[21] Appl. No.: 715,692

[22] Filed: Aug. 19, 1976

Related U.S. Application Data

[63] Continuation of Ser. No. 534,876, Dec. 20, 1974, abandoned.

[51] Int. Cl.[2] ..... E06B 3/26

[52] U.S. Cl. ..... 52/202; 52/222; 52/827; 160/394; 160/397; 403/231

[58] Field of Search ..... 52/202, 222, 628, 758 H, 52/824, 827; 160/381, 392, 393, 394, 397; 403/231, 205

[56] References Cited

U.S. PATENT DOCUMENTS

| | | | |
|---|---|---|---|
| 1,120,686 | 12/1914 | Burrowes | 160/397 |
| 2,030,135 | 2/1936 | Carpenter | 52/173 |
| 2,042,726 | 6/1936 | Mueller | 160/394 |
| 2,927,354 | 3/1960 | Lauer | 52/656 |
| 3,143,165 | 8/1964 | Lewis et al. | 160/394 |
| 3,165,110 | 1/1965 | Brooks | 52/222 |
| 3,381,433 | 5/1968 | Davis, Jr. | 52/364 |
| 3,973,371 | 8/1976 | Heller | 52/461 |

FOREIGN PATENT DOCUMENTS

| | | | |
|---|---|---|---|
| 1283356 | 12/1961 | France | 403/205 |

*Primary Examiner*—Alfred C. Perham
*Attorney, Agent, or Firm*—Thomas E. Spath

[57] ABSTRACT

A film supporting frame structure suitable for use as a residential storm or insulating window, is assembled from frame members having upper and lower channels, and secured together by corner brackets having prongs which mate with the lower frame channels. The assembled frame is covered with a flexible film which is stretched and held securely in the upper frame channels by interlocking tee-members. To facilitate mounting, the frame is provided with a flange and a pressure sensitive resilient adhesive strip.

10 Claims, 6 Drawing Figures

FRAME STRUCTURE

REFERENCE TO RELATED APPLICATION

This application is a continuation of our earlier copending application Ser. No. 534,876 which was filed on Dec. 20, 1974, now abandoned.

BACKGROUND OF THE INVENTION

Flexible plastic films have come into wide-spread use as an insulating or barrier material. Transparent flexible plastic films are commonly used in place of residental wooden or aluminum sash type glass storm windows.

Translucent or transparent flexible film has also been widely used in the construction trade to cover large openings during building construction to protect personnel and equipment from wind, precipitation and other inclemencies of weather. In such applications the flexible film is stretched over the opening and nailed, stapled, or fastened with battens or other means to the window frame.

These methods of affixing the flexible sheeting material to the openings to be covered or insulated have the following drawbacks and deficiencies: (1) it is difficult, if not impossible, to stretch the flexible film uniformly to remove all wrinkles when using staples or battens; (2) the film cannot be easily removed for purposes of cleaning the primary window surfaces behind the film; (3) once the film is removed it may not be in a condition suitable for re-use; (4) the primary window frame may itself be damaged by the use of nails or staples; (5) the insulating efficiency of the film is greatly reduced where only nails or staples are used to secure the film to the frame; (6) construction of a proper fitting wooden frame which is removable is expensive and time consuming; (7) the appearance of the film affixed directly to the window frame or to a crude fitting wooden frame is not aesthetically pleasing, especially for residential window use.

Using the frame structure of our invention the above-mentioned drawbacks to the use of flexible film are eliminated and an aesthetically pleasing frame supporting a tautly stretched transparent flexible film can be quickly and easily constructed. In its preferred embodiment the film covered supporting frame structure is especially adaptable as a substitute for more expensive conventional wood or aluminum storm windows in residential use. It is not only lightweight and easy to install, it may be readily removed for cleaning or maintenence of the windows and frames, and to provide summer ventilation. Optionally, a tinted flexible film can be installed for use on the sunny side of air-conditioned rooms. The invention has the particular advantage of allowing the flexible film to be removed and re-installed or replaced without having to remove its supporting frame from the window.

The film supporting frame structure of our invention can be quickly assembled and installed using only hand tools. The structure contains no mitered joints and only reasonable manual skill is required in its construction. Moreover, the structure of our invention can be assembled from its component parts to fit other than standard size window openings and mounted to provide efficient, air-tight insulative seals.

The film supporting frame structures of our invention are also suitable for use in the construction trade. By providing the frame with sufficient cross-members, as described hereinafter, a large but light-weight structure can be made. Typically, in the construction of high rise buildings, protection of personnel and equipment is required for only several floors at a time. As electricians, plumbers and other tradesmen complete work on one floor and move up through the building, the frame structure can be easily removed and re-installed above. Use of the frame structure of our invention results in the saving of manpower and material since there is no need to construct temporary wooden frames or to discard film material which is damaged during removal and re-installation. As it will also be appreciated from the detailed description below, the frame structure of our invention can be readily disassembled, without damaging its interchangeable component parts, and transported for re-assembly in a different size at a different location.

These and other advantages will be appreciated as the invention is described in detail below and with reference to the attached drawings, wherein.

Figure 3:
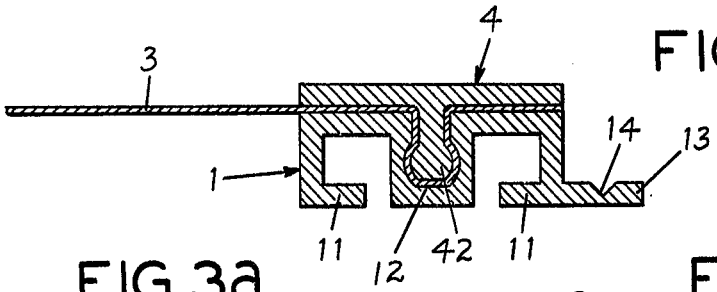
FIG. 3 is a cross-sectional view taken through a typical assembled frame member.
Figure 3A:
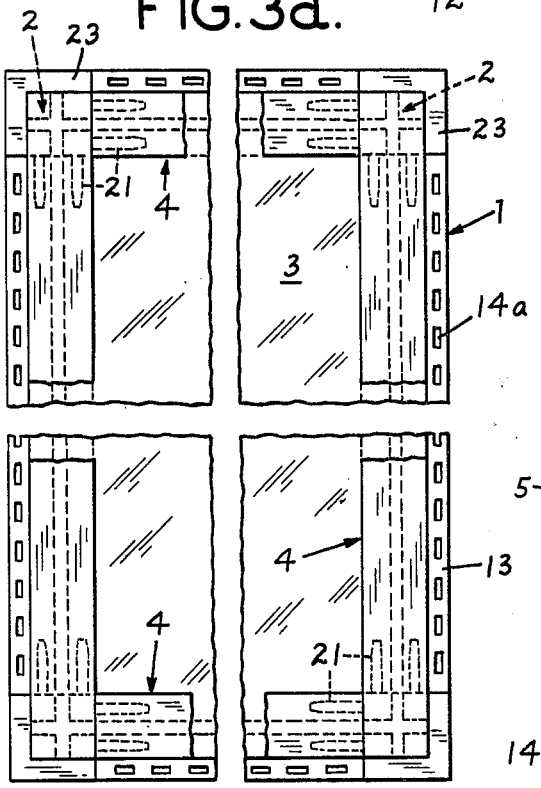

FIG. 3*a* is a plan view of the assembled frame structure.

Figure 4:
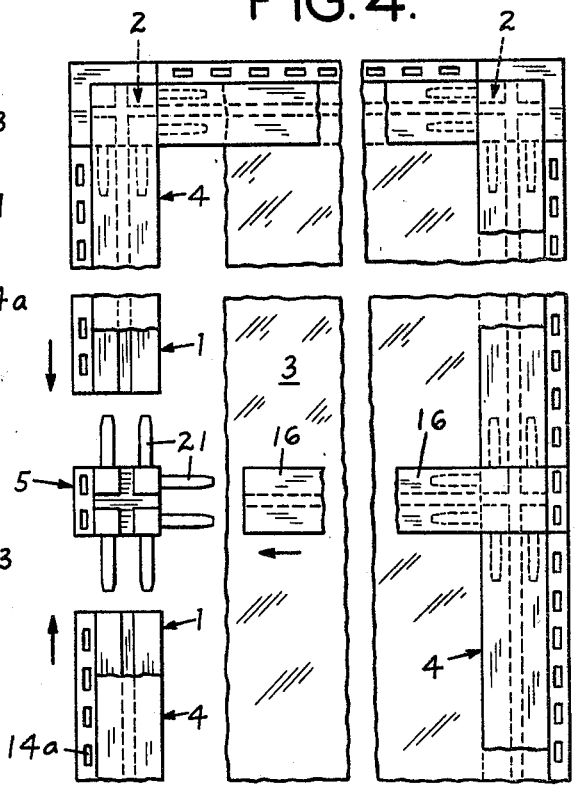
Figure 5:
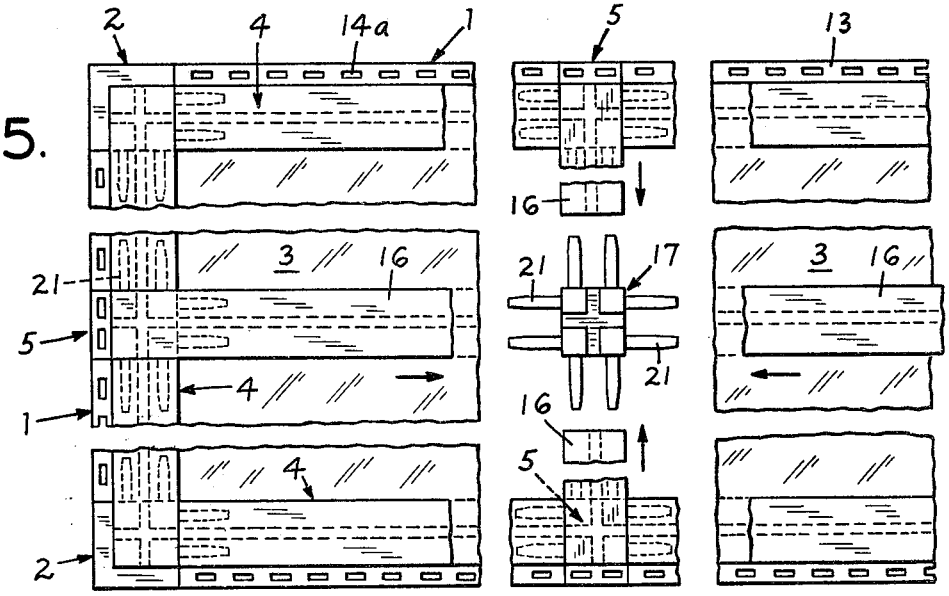

FIG. 4 is an exploded plan view of another embodiment of the film supporting frame structure of our invention; and FIG. 5 is a plan view of a further embodiment of the film support frame structure of our invention.

Figure 1:
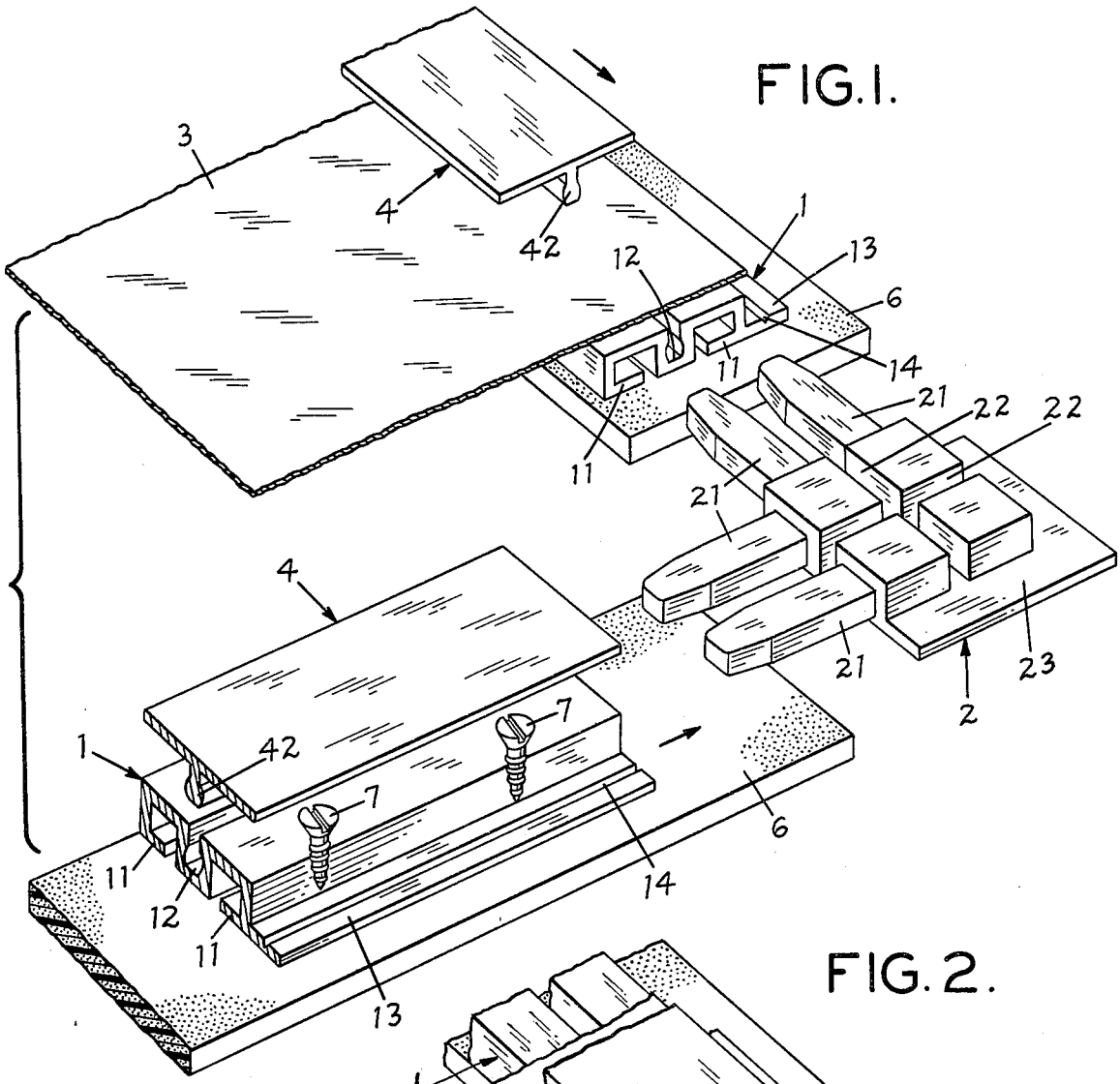
FIG. 1 is an exploded perspective view of one corner of the frame structure.
Figure 2:
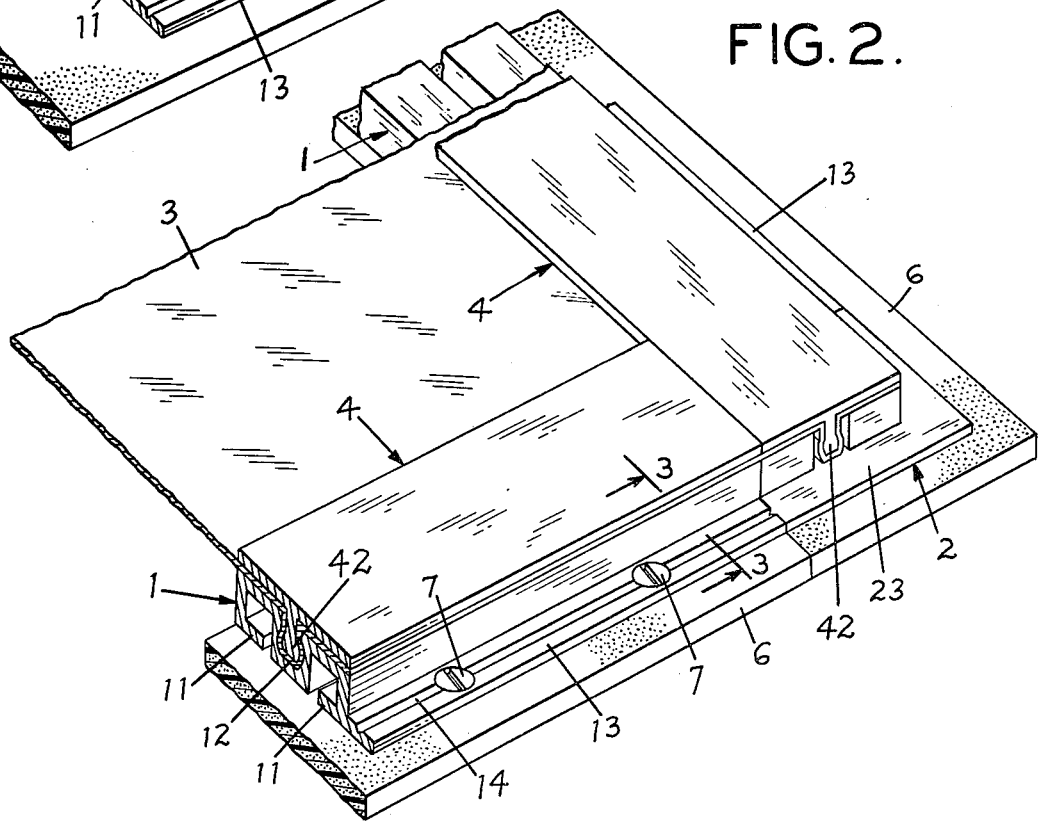
FIG. 2 is a perspective of a sub-assembly of the structure shown in FIG. 1.

With specific reference to FIG. 1 there is shown frame member 1 having two parallel lower channels of like or similar configuration running therethrough, and communicating with the ends of the frame member. The upper face of frame member 1 is provided with an open channel or groove 12 parallel to the longitudinal axis of the member, and located about midway between lower channels 11. In the preferred embodiment shown in FIG. 1 the frame member 1 is provided with flange 13, which not only gives additional strength and rigidity to the frame member and the assembled structure but also facilitates mounting of the structure using nails, screws, staples or like means. In order to further facilitate mounting, flange 13 is provided with a groove 14, or other intermittent recessed areas or holes where the flange thickness is reduced so that mounting screws 7 or other fastening means can be pushed through by hand or by light hammer blows. These weakened areas obviate the need for drilling holes to receive the fastening means. The ability to mount the structure using only hand tools is a considerable advantage where power tools are unavailable and installation must be made from a precarious position, such as from atop a ladder.

Side and end frame members 1 are assembled by means of corner brackets 2. Bracket 2 is preferably provided with at least two prongs 21, extending at right angles from the bracket. In the embodiment shown in FIG. 1 each pair of projecting prongs 21 are positioned to mate with the lower channels 11 of the frame members 1.

It is to be understood that the number of prongs and their specific configuration is not intended to be limited to the two as shown in FIG. 1. A consideration is that the matching lower channels in the frame members should not be so numerous or of such volume as to substantially weaken the frame members. In the preferred embodiments shown in the drawings, the frame members can be commercially produced by extruding polymeric materials such as polyvinyl chloride, ABS, etc., or metals such as aluminum. When frame members are produced by the extrusion process the longitudinal lower channels 11 will run the entire length of the members and will communicate with the rear surface of the member as well as both ends. Alternatively, frame members can be cast or machined to the proper configuration with the lower channels extending inwardly a distance sufficient to permit mating of the prongs 21 of corner bracket 2.

Frame members produced from the above-mentioned materials are of high strength but are lightweight and can be cut with a hacksaw.

Corner brackets can be cast or machined from suitable plastic materials or metals.

The respective cross-sectional configuration of the projecting prongs and matching lower channels and their tolerances are such that a secure press fit is obtained. In the preferred embodiment of FIG. 1, the corner bracket 2 is additionally provided with a flange 23, corresponding to the flange 13 of the frame members 1 which it joins. Bracket 2 is optionally provided with upper open channels 22, in alignment with corresponding upper channels 12 of the frame members.

After frame members 1 are assembled to corner brackets 2 to construct the rectilinear frame structure, flexible web 3 is positioned to cover the entire upper surface of the frame members.

Tee-member 4, with projecting tongue 42 is pressed down over the web material securing itself and the edges of film 3 into upper channel 12 of frame members 1. Tee-member 4 is additionally capable of fitting into corner piece 2.

As shown in the cross-sectional view of FIG. 3, the configuration and tolerances of tongue 42 of tee-member 4 and upper channel 12, are such that when assembled with flexible web 3, a secure interlocking fit is obtained. In the preferred embodiment shown in FIG. 3, the cross-sectional dimension at the bottom portion of channel 12 is slightly wider than that of the channel opening. Likewise, the lower portion of tongue 42 which is of the same or approximately the same cross-section configuration as channel 12 is wider than the channel opening through which it must pass to secure the flexible film. This press or snap fit of the resilient materials results in an air-tight seal.

While any type of flexible film can be used if it has the requisite tear strength and resistance to weathering, we have found that the transparent vinyl film marketed by Tenneco Chemicals, Inc. under the trademark ROLLAGLASS possesses properties especially suited for use with our invention. It has excellent optical properties, including high light transmission and low distortion.

It will readily be appreciated that in constructing the rectilinear frame structure of our invention, that the length of the frame members comprising the top and bottom ends and the sides of the structure will be determined by the size of the opening to be covered taking into account the dimensions of the respective flanges and of the corner brackets. The assembled frame is shown in FIG. 3*a*.

In order to aid in mounting the assembled film supporting frame structure, the rear face of the frame members may be provided with corresponding lengths of pressure-sensitive double faced adhesive strips. As shown in FIG. 1 this mounting strip can serve as additional weather-stripping 6, by utilizing a flexible resilient foam material, extending slightly beyond flange 13.

When nailed or otherwise secured over a primary window frame, the film 3 can be removed after prying off the tee-members 4. In areas where seasonal air-conditioning is required a tinted vinyl film can replace the clear. In areas where screen material is required, a flexible screen can replace the vinyl.

A further embodiment of our invention is shown in FIGS. 4 and 5. In the exploded segmented view of FIG. 4 there is shown a tee-bracket of construction similar to that of the corner brackets 2 described above. The tee bracket as shown has an additional pair of prongs 21 so that cross-member 6 can be joined at right angles to flange members 1. The configuration of the cross-member is identical to that of the frame members previously described, the term cross-member being used only to distinguish the internal support member from those comprising the outer frame structure. Using tee-brackets 5, a larger and more rigid frame structure can be constructed.

The embodiment of our invention shown in the partially exploded and segmented view of FIG. 5, has utility where requirements of size, rigidity, or both necessitate the joining of intersecting cross-members to support the frame structure. The cross-bracket 7 is of a construction similar to that of corner bracket 2 and tee-bracket 5, additionally having prongs 21 extending at right angles from all four sides to mate with corresponding channels in the four intersecting cross-members 6.

What is claimed is:

1. In kit form for assembly as a rectilinear film supporting frame structure, component parts consisting of (a) at least four extruded rigid frame members each having an upper open longitudinal channel extending the length thereof and communicating with the upper surface of the frame member, each frame member also having lower longitudinal channels communicating with both ends thereof;

(b) four corner brackets for joining the frame members, each corner bracket having prongs projecting from two sides thereof at right angles and designed to securely mate with the lower longitudinal channel opening in the frame member components, the upper surface of each corner bracket having intersecting upper open channels extending across said surface, and aligned with the upper open longitudinal channels of the frame members when mated;

(c) a thin flexible film of dimensions which are at least coextensive with those of the mated corner brackets and frame members; and (d) at least four extruded rigid interlocking tee-members for securing the edges of said thin flexible film within the upper open longitudinal channels of the frame member and the corner bracket components in the mated position.

2. The kit of claim 1, wherein the frame member and corner bracket components are provided with mounting flanges extending outwardly therefrom.

3. The kit of claim 2, wherein the frame member mounting flanges are provided with weakened areas to facilitate the penetration of fastening means.

4. The kit of claim 1, wherein the rear surfaces of the frame members and corner bracket components are provided with a resilient double-faced pressure sensitive adhesive mounting strip made of foam material.

5. The kit of claim 1, wherein the frame member components have at least two lower longitudinal channels communicating with each end thereof, and the corner bracket components have two pairs of projecting prongs designed to mate with said lower longitudinal channels.

6. The kit of claim 1, wherein the frame members and interlocking tee-member components are extruded rigid plastic.

7. The kit of claim 1, wherein the thin flexible film is a tinted transparent vinyl material.

8. The kit of claim 1, wherein the thin flexible film component is a screen material.

9. The kit of claim 1 which consists of the further component parts:

(a) at least one cross-member of the same configuration as the frame member components; and (b) at least two tee-brackets each having prongs projecting from three sides thereof in a rectilinear configuration, said prongs designed to mate with the lower longitudinal channels of the frame and cross-member components, the upper surface of each tee-bracket having intersecting upper open channels extending across said surface, and aligned with the upper open longitudinal channels of the frame member and cross-member components when mated.

10. The kit of claim 9 which consists of the further component parts:

at least one cross-bracket having prongs projecting from all four sides thereof in a rectilinear configuration, said prongs designed to mate with the lower longitudinal channels of the cross-member components, the upper surface of the cross-bracket having intersecting upper open channels extending across said surface, and aligned with the upper open longitudinal channels of the cross-member components when mated.

* * * * *